US007353767B2

(12) United States Patent
Taelman

(10) Patent No.: US 7,353,767 B2
(45) Date of Patent: Apr. 8, 2008

(54) UNDERWATER RECREATION APPARATUS AND METHOD THEREFOR

(76) Inventor: Thomas R. Taelman, 4948 E. Raintree Cir., Cave Creek, AZ (US) 85331

( * ) Notice: Subject to any disclaimer, the term of this patent is extended or adjusted under 35 U.S.C. 154(b) by 0 days.

(21) Appl. No.: 11/419,722

(22) Filed: May 22, 2006

(65) Prior Publication Data

US 2006/0260528 A1 Nov. 23, 2006

Related U.S. Application Data

(60) Provisional application No. 60/683,819, filed on May 23, 2005.

(51) Int. Cl.
*B63C 11/46* (2006.01)

(52) U.S. Cl. ..... 114/315; 114/245; 114/253

(58) Field of Classification Search ..... 114/315, 114/253, 254, 244, 245; 405/186
See application file for complete search history.

(56) References Cited

U.S. PATENT DOCUMENTS 3,084,653 A * 4/1963 Lepine et al. ..... 114/245
3,101,691 A * 8/1963 Wendt ..... 114/245
4,919,631 A * 4/1990 Stafford ..... 441/40
7,004,099 B2 * 2/2006 Iijima et al. ..... 114/315

FOREIGN PATENT DOCUMENTS

FR 2635307 A * 2/1990

OTHER PUBLICATIONS

Translation of FR 2635307.*

* cited by examiner

*Primary Examiner*—Sherman Basinger
(74) *Attorney, Agent, or Firm*—Veronica-Adele R. Cao; Weiss & Moy, P.C.

(57) ABSTRACT

An underwater recreation apparatus and method therefor. The apparatus allows a diver to explore varying water depths with a minimal amount of equipment and with manageable equipment. The apparatus also allows the diver to cover substantial distances with minimal physical strain.

12 Claims, 2 Drawing Sheets

UNDERWATER RECREATION APPARATUS AND METHOD THEREFOR

CROSS REFERENCE TO RELATED APPLICATIONS

This application claims priority to a corresponding provisional application U.S. Ser. No. 60/683,819, filed May 23, 2005 in the name of the applicant of this application.

FIELD OF THE INVENTION

This invention relates generally to underwater recreation and, more specifically, to an underwater recreation apparatus that allows a diver to explore varying water depths with minimal and manageable equipment.

BACKGROUND OF THE INVENTION

Three well-known underwater recreational activities are self-contained underwater breathing apparatus (SCUBA) diving, snorkeling, and Snuba® diving. However, these underwater recreational activities either require burdensome equipment or in some way restrict the diver to shallow depths near the shore.

A SCUBA diver is able to reach water depths of greater than one hundred feet. Although the diver is allowed a great amount of mobility, the equipment involved with SCUBA diving is usually very heavy and cumbersome. Typically, a SCUBA diver will carry about sixty to seventy-five pounds of equipment with him/her out into the water. Divers usually breathe compressed air or Nitrox which is contained in a cylinder carried on the diver's back. The typical cylinder is made of aluminum and weighs about thirty-one pounds when empty. When filled with about 3,000 psi of gas, the cylinder can weigh up to seven pounds more. Divers usually carry additional smaller air tanks, in preparation for any emergencies that may arise. To control buoyancy, a SCUBA diver must also carry a Buoyancy Control Device. The diver must also wear additional lead weights, due to the natural buoyancy of the diver's wet suit. A SCUBA diver typically also uses a mask, fins to propel him/her, and a regulator which allows the diver to breathe the air from the cylinder.

Snorkeling on the other hand, does not require as much equipment as SCUBA diving. A snorkeler typically uses only a mask, a snorkel, and fins. A snorkeler uses a J-shaped hollow snorkel to breathe air directly from the atmosphere. And because a snorkeler does not use any gas cylinders, the snorkeler must keep one end of the snorkel above water-level at all times. Therefore, the snorkeler cannot explore the deeper parts of the water the way a SCUBA diver can.

Snuba® is a combination of SCUBA diving and snorkeling. While underwater, a Snuba® diver breathes through a twenty-foot air hose which is connected to a standard SCUBA cylinder located on an inflatable raft. As the Snuba® diver swims, he/she tows the raft along with him/her. Although Snuba® diving relieves the diver from having to carry the heavy SCUBA equipment, it is dangerous for a diver to be coupled to an unattended raft. High winds and strong current may capsize or drag the raft, pulling the Snuba® diver along with it. Furthermore, the Snuba® diver would not know if there are any leaks or other problems with the cylinder, since no one is present on the raft to monitor it or warn the diver. Furthermore, a Snuba® diver may only explore those areas to which he/she can swim. If a Snuba® diver is not a very strong swimmer, he/she may not be able to venture that far away from shore for fear that he/she may not be able to swim the distance back.

Therefore a need existed for an underwater recreation apparatus that allows a diver to explore varying water depths with minimal and manageable equipment and that allows the diver to cover substantial distances with minimal physical strain.

SUMMARY OF THE INVENTION

An object of the present invention is to provide an improved underwater recreation apparatus.

Another object of the present invention is to provide an underwater recreation apparatus that allows a diver to explore varying water depths with a minimal amount of equipment.

Another object of the present invention is to provide an underwater recreation apparatus that allows a diver to explore varying water depths with manageable equipment.

Still another object of the present invention is to provide an underwater recreation apparatus that allows the diver to cover substantial distances with minimal physical strain.

BRIEF DESCRIPTION OF THE PREFERRED EMBODIMENTS

In accordance with one embodiment of the present invention, an underwater recreation apparatus is disclosed. The underwater recreation apparatus comprises a frame, at least one handle pivotally coupled to the frame, and a rudder coupled to the at least one handle.

In accordance with another embodiment of the present invention, an underwater recreation apparatus is disclosed. The underwater recreation apparatus comprises a substantially hollow frame, an air hose coupled to a first aperture defined by the frame, a regulator coupled to a second aperture defined by the frame, at least one handle pivotally coupled to the frame, and a rudder coupled to the at least one handle, the rudder being dimensioned to fit within an inner perimeter defined by the frame.

In accordance with another embodiment of the present invention, a method of underwater recreation is disclosed. The method comprises the steps of providing a watercraft and providing an underwater recreation apparatus comprising a frame, at least one handle pivotally coupled to the frame, and a rudder coupled to the at least one handle. The method further comprises the steps of connecting the underwater recreation apparatus to the watercraft, gripping the at least one handle by a user, towing the user of the underwater recreation apparatus by the watercraft, pivoting the at least one handle about the frame, and adjusting an angle of the rudder relative to the frame to affect at least one of an upward direction, a straight direction, and a downward direction of the user during towing.

DETAILED DESCRIPTION OF THE PREFERRED EMBODIMENTS

Figure 1:
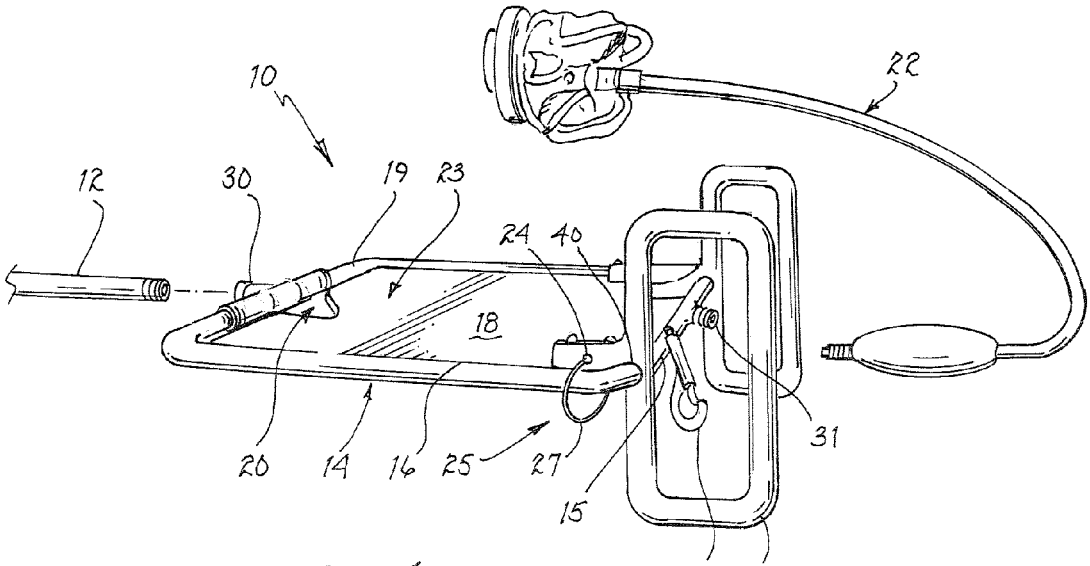
FIG. 1 is a perspective view of the underwater recreation apparatus of the present invention.
Figure 2:
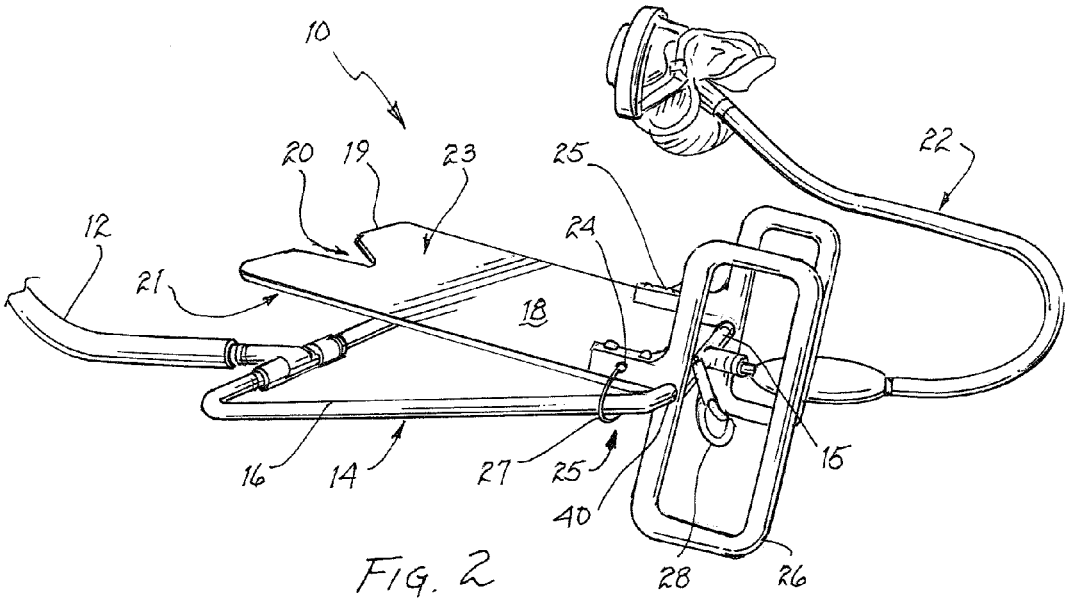
FIG. 2 is a perspective view of the underwater recreation apparatus of FIG. 1, shown with the rudder in an upwardly angled position.
Figure 3:
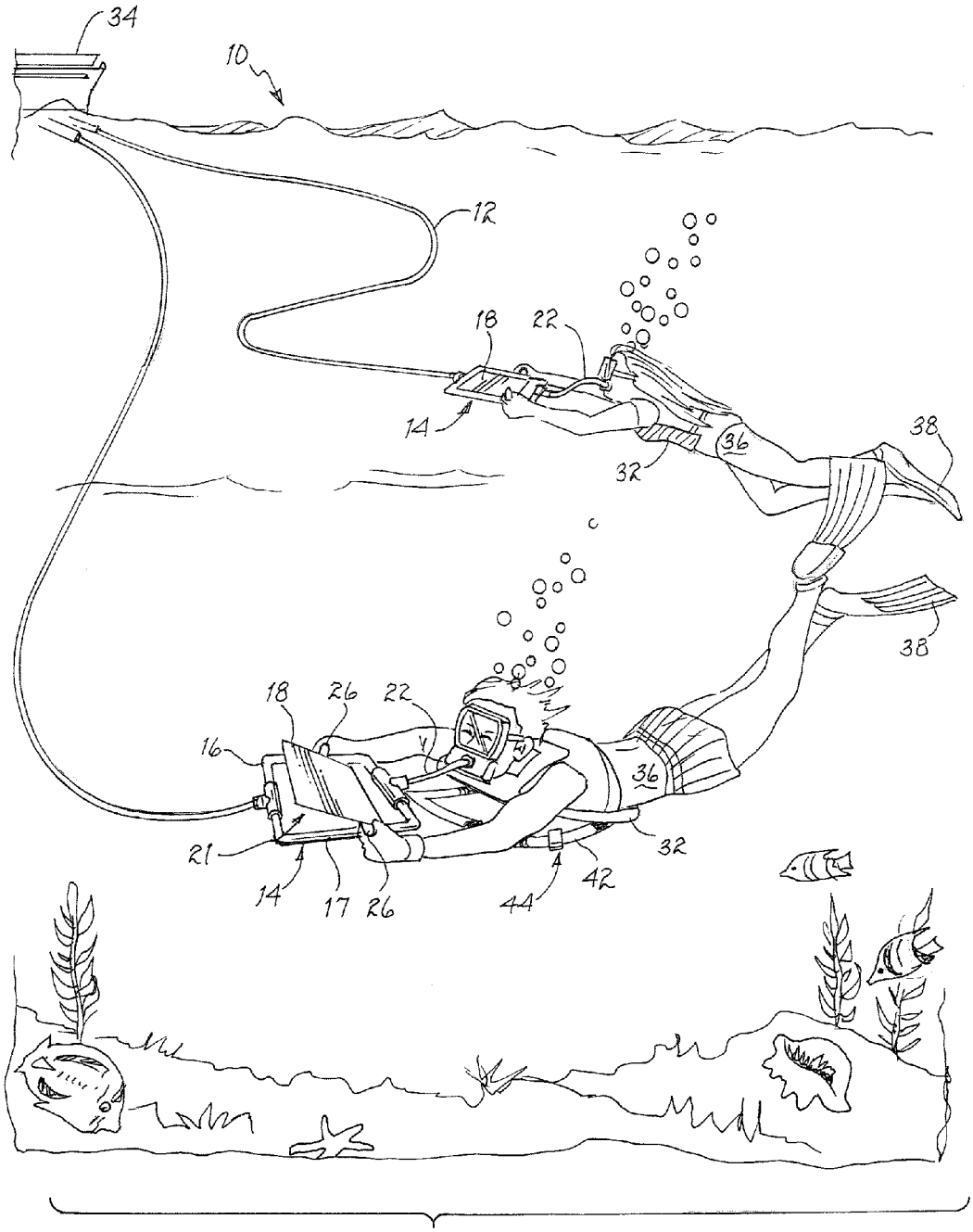
FIG. 3 is a perspective view of the underwater recreation apparatus of FIG. 1, shown in use.

Referring to FIGS. 1-3, an underwater recreation apparatus, hereinafter underwater recreation apparatus 10, is disclosed. The underwater recreation apparatus 10 comprises, in combination, a watercraft 34 (see FIG. 3), an air hose 12, a frame 14, and a regulator 22.

As shown, both the air hose 12 and the regulator 22 are coupled to the frame 14. Preferably, the air hose 12 is coupled to a first aperture 30 (see FIG. 1) defined by the frame 14 and the regulator 22 is coupled to a second aperture 31 (see FIG. 1) defined by the frame 14. The frame 14 is substantially hollow so that air may pass from the air hose 12, through the first aperture 30, through the frame 14, through the second aperture 31, through the regulator 22, and to the diver 36 (see FIG. 3). It should be clear that for purposes of this invention the word "air" includes all breathable gas combinations, including, but not limited to: pure oxygen, tri-mix (i.e. a mixture of helium, oxygen and nitrogen) and an oxygen-nitrogen combination. Preferably, the frame 14 is constructed of stainless steel tubing, however it should be clearly understood that an alternative material may be used so long as the frame 14 maintains its structural integrity. And although the frame 14 is shown as having a substantially square/rectangular configuration, it should be understood that substantial benefit may be derived from the frame 14 having an alternative shape.

The underwater recreation apparatus 10 preferably has a rudder 18 to help the diver 36 navigate underwater. Preferably, the rudder 18 is coupled to two handles 26 and is dimensioned to fit within an inner perimeter 16 of the frame 14. It should be clearly understood, however, that further substantial benefit may be derived from only one handle 26. As shown in FIGS. 1 and 2, the handles 26 may be coupled to an end 15 of the frame 14 proximate the diver 36 or, as shown in FIG. 3, the handles 26 may be coupled to the sides 17 of the frame 14. It should also be clearly understood that further substantial benefit may be derived from the rudder 18 being coupled directly to the frame 14 and from the handles 26 being coupled to the rudder 18 only.

Each handle 26 preferably defines a bore 40 (see FIGS. 1 and 2) therethrough, the bore 40 being dimensioned to be rotatably coupled about a portion of the frame 14. As the diver 36 rotates the handles 26 downwardly, the rudder 18 moves to a downwardly angled position (not shown) and as the diver 36 rotates the handles 26 upwardly, the rudder 18 moves to an upwardly angled position (shown in FIGS. 2 and 3). In order to reduce drag on the diver 36 in steering while underwater, one edge 19 (see FIGS. 1 and 2) of the rudder 18 may preferably have a substantially V-shaped notch 20 (see FIGS. 1 and 2). It should be clearly understood, however, that substantial benefit may be derived from an alternatively shaped notch 20.

In order to keep the rudder 18 from angling upwardly and downwardly too quickly, the frame 14 may have at least one restraint 25 (see FIGS. 1 and 2) coupled thereto, confining the movement of the rudder 18 within a certain range of angles. It is preferred that the restraint 25 comprise at least one aperture 24 defined by a portion of the handle 26 proximate the rudder 18 and a ring 27 passing through the aperture 24 and about a portion of the frame 14 proximate the aperture 24. However, it should be clearly understood that substantial benefit may be derived from an alternative form of restraint 25, so long as the restraint 25 prevents the rudder 18 from angling upwardly and downwardly too quickly and/or at too great an angle. And while it is preferred that the ring 27 be adjustable, it should be clearly understood that substantial benefit may be derived from a ring 27 that is not adjustable.

Preferably, the underwater recreation apparatus 10 is equipped with a latch 28 (see FIGS. 1 and 2). The latch 28 is dimensioned to secure the ends of a body strap 42 (see FIG. 3) that is wrapped about the body of the diver 36. The body strap 42 and latch 28 allow the diver 36 to be pulled by the moving watercraft 34, thereby minimizing the amount of physical strain on the diver 36. Further preferably, the body strap 42 will be equipped with a quick-release mechanism 44 (see FIG. 3) that will allow the diver 36 to quickly remove the body strap 42 from around his/her body in the event of an emergency or merely for convenience.

STATEMENT OF OPERATION

The air hose 12 of the underwater recreation apparatus 10 is preferably coupled to at least one air cylinder (not shown) located on a watercraft 34. Although it is preferred that the watercraft 34 be an inflatable watercraft with an electric motor, it should be clearly understood that the underwater recreation apparatus 10 may be towed by any watercraft, so long as the watercraft is powerful enough to tow the underwater recreation apparatus 10 and divers 36 and is capable of maintaining a safe speed for the divers 36. The length of the air hose 12 may vary depending upon the diver 36. For example, if a diver 36 is not certified, the diver 36 is legally required to use an air hose 12 no longer than twenty feet. If a diver 36 is certified, he/she may use an air hose 12 of any length. It should be clearly understood that the underwater recreation apparatus 10 may be used to allow the diver 36 to explore varying water depths, depending upon the diver's 36 ability and certification.

In the preferred embodiment, the air hose 12 both delivers a breathable gas mixture and serves as a towing cable for towing the underwater recreation apparatus 10. However, it should be clear that substantial benefit could be derived from an alternative embodiment of the present invention in which two or more towing cables are used, one or more for delivering breathable gas and one or more for towing the underwater recreation apparatus 10. It should also be clearly understood that substantial benefit may also be derived from the underwater recreation apparatus 10 wherein the air hose 12 was replaced by a towing cable, and the diver 36 received air from an air canister worn on his/her person.

As the watercraft 34 moves, the divers 36 grip the handles 26 of the underwater recreation apparatus 10. If the diver 36 wishes to maintain a straight course, the diver 36 will simply keep the rudder 18 level with the frame 14. If the diver 36 wishes to ascend in the water, the diver 36 will rotate the handles 26 upwardly so that the rudder 18 is angled upwardly. As the diver 34 is pulled by the watercraft 34, the water pushes against a bottom surface 21 (see FIGS. 2 and 3) of the rudder 18, therefore causing the diver 36 to ascend. And if the diver 36 wishes to descend in the water, the diver 36 will rotate the handles 26 downwardly so that the rudder 18 is angled downwardly. As the diver 36 is pulled by the watercraft 34, the water pushes against a top surface 23 (see FIGS. 1 and 2) of the rudder 18, therefore causing the diver 36 to descend.

The diver 36 may also tilt the frame 14 in order steer either to the left or to the right. If the diver 36 wishes to maintain a straight course, the diver 36 will simply refrain from tilting the frame 14. Thus, because he/she is being pulled by the watercraft 34, the diver 36 is not required to swim.

While the invention has been particularly shown and described with reference to preferred embodiments thereof, it will be understood by those skilled in the art that the foregoing and other changes in form and details may be made therein without departing from the spirit and scope of the invention. For example, while the divers 36 are shown as using fins 38 (see FIG. 3) to help propel them through the water, it should be understood that substantial benefit may still be derived without the use of fins 38, as the momentum of the watercraft 34 would be sufficient to move the divers 36 through the water. And while a safety vest 32 (see FIG. 3) is recommended and possibly required for a diver 36, the safety vest 32 is not necessary to the function of the underwater recreation apparatus 10. And finally, although it is preferred that a latch 28 and body strap 28 be used, it should be clearly understood that substantial benefit may still be derived if the latch 28 were connected directly to the diver's 36 safety vest 32 or if the underwater recreation apparatus 10 did not have a latch 28 or body strap 28.

I claim:

1. An underwater recreation apparatus comprising:

a substantially hollow frame;

an air hose coupled at one end to a first aperture defined by said frame;

a regulator coupled at one end to a second aperture defined by said frame;

at least one handle pivotally coupled to said frame; and a rudder coupled to said at least one handle, said rudder being dimensioned to fit within an inner perimeter defined by said frame.

2. The underwater recreation apparatus of claim 1 wherein said apparatus comprising two handles coupled to one end of said frame proximate a user.

3. The underwater recreation apparatus of claim 1 wherein said apparatus comprising two handles, one of said two handles being coupled to one side of said frame and the other of said two handles being coupled to the other side of said frame.

4. The underwater recreation apparatus of claim 1 wherein said rudder defines at least one notch along an outer edge of a said rudder, said notch being located opposite said at least one handle.

5. The underwater recreation apparatus of claim 1 further comprising at least one restraint coupled to said frame, said at least one restraint confining movement of said rudder within a preferred range.

6. The underwater recreation apparatus of claim 1 further comprising a latch coupled to said frame, said latch dimensioned to be removably coupled to one of a body strap worn by a user and a vest worn by a user.

7. The underwater recreation apparatus of claim 6 wherein said body strap worn by a user having a quick-release mechanism integrally coupled thereto.

8. A method of underwater recreation comprising the steps of:

providing a watercraft;

providing an underwater recreation apparatus comprising: a frame, wherein said frame being substantially hollow; at least one handle pivotally coupled to said frame; and a rudder coupled to said at least one handle;

connecting said underwater recreation apparatus to said watercraft;

connecting one end of an air hose to said at least one air cylinder and the other end of said air hose to a first aperture defined by said frame;

connecting one end of a regulator to a second aperture defined by said frame;

breathing by said user through the other end of said regulator;

gripping said at least one handle by a user;

towing said user of said underwater recreation apparatus by said watercraft;

pivoting said at least one handle about said frame; and adjusting an angle of said rudder relative to said frame to affect at least one of an upward direction, a straight direction, and a downward direction of said user during towing.

9. The method of claim 8 further comprising the step of tilting said apparatus to affect at least one of a leftward direction, a straight direction, and a rightward direction of said user during towing.

10. The method of underwater recreation of claim 8 further comprising the steps of:

providing a latch coupled to said frame; and connecting said latch to one of a body strap worn by said user and a safety vest worn by said user.

11. The method of underwater recreation of claim 8 wherein said A wherein said underwater recreation apparatus comprise two handles coupled to one end of said frame.

12. The method of underwater recreation of claim 8 wherein said underwater recreation apparatus further comprises at least one restraint coupled to said frame, said at least one restraint confining movement of said rudder within a preferred range.

* * * * *